United States Patent [19]

Pav et al.

[11] Patent Number: 4,497,246

[45] Date of Patent: Feb. 5, 1985

[54] METHOD OF AND ARRANGEMENT FOR PROCESSING LENGTHS OF MATERIAL

[75] Inventors: Josef Pav, Krefeld; Heinz Jaegers, Duisburg, both of Fed. Rep. of Germany

[73] Assignee: Kleinewefers GmbH, Krefeld, Fed. Rep. of Germany

[21] Appl. No.: 489,548

[22] Filed: Apr. 28, 1983

[30] Foreign Application Priority Data

Apr. 30, 1982 [DE] Fed. Rep. of Germany ..... 3216182

[51] Int. Cl.[3] ..... B30B 3/04

[52] U.S. Cl. ..... 100/35; 100/47; 100/162 R; 100/170

[58] Field of Search ..... 100/47, 35, 93 RP, 168, 100/169, 162 R, 162 B, 172, 173

[56] References Cited

U.S. PATENT DOCUMENTS

| | | | |
|---|---|---|---|
| 3,230,867 | 1/1966 | Nelson | 100/93 RP |
| 3,254,593 | 6/1966 | Beachler | 100/162 R X |
| 4,128,053 | 12/1978 | Kankaanpaa | 100/162 R |
| 4,194,446 | 3/1980 | Palovaara | 100/170 X |
| 4,211,165 | 7/1980 | Schill | 100/162 R |
| 4,326,456 | 4/1982 | Kankaanpaa | 100/162 R X |
| 4,332,191 | 6/1982 | Kankaanpaa | 100/162 R |
| 4,366,752 | 1/1983 | Koski | 100/170 X |
| 4,375,188 | 3/1983 | Leiviska | 100/168 X |

*Primary Examiner*—Peter Feldman

*Attorney, Agent, or Firm*—Peter K. Kontler

[57] ABSTRACT

An arrangement for calendering bands of paper and like materials has one or more inelastic calendering rollers. Elastically deformable working rollers are associated with the calendering roller or rollers and are movable between operative positions in which they cooperate with the calendering roller or rollers to calender the bands and inoperative positions. Each of the rollers is rotated at a predetermined peripheral speed at which it calenders the bands. At least one of the working rollers has a drive capable of rotating it at a peripheral speed which is a small fraction of the predetermined peripheral speed. This working roller serves as a spare and is held in its inoperative position during a calendering operation while being rotated at a lower peripheral speed. When one of the working rollers in use becomes damaged or worn, the spare working roller is accelerated to the speed of the other rollers and is then moved to its operative position in order to assume the function of the damaged or worn working roller. The damaged or worn working roller is simultaneously moved to its inoperative position so that it may be repaired or replaced.

64 Claims, 8 Drawing Figures

FIG. 1
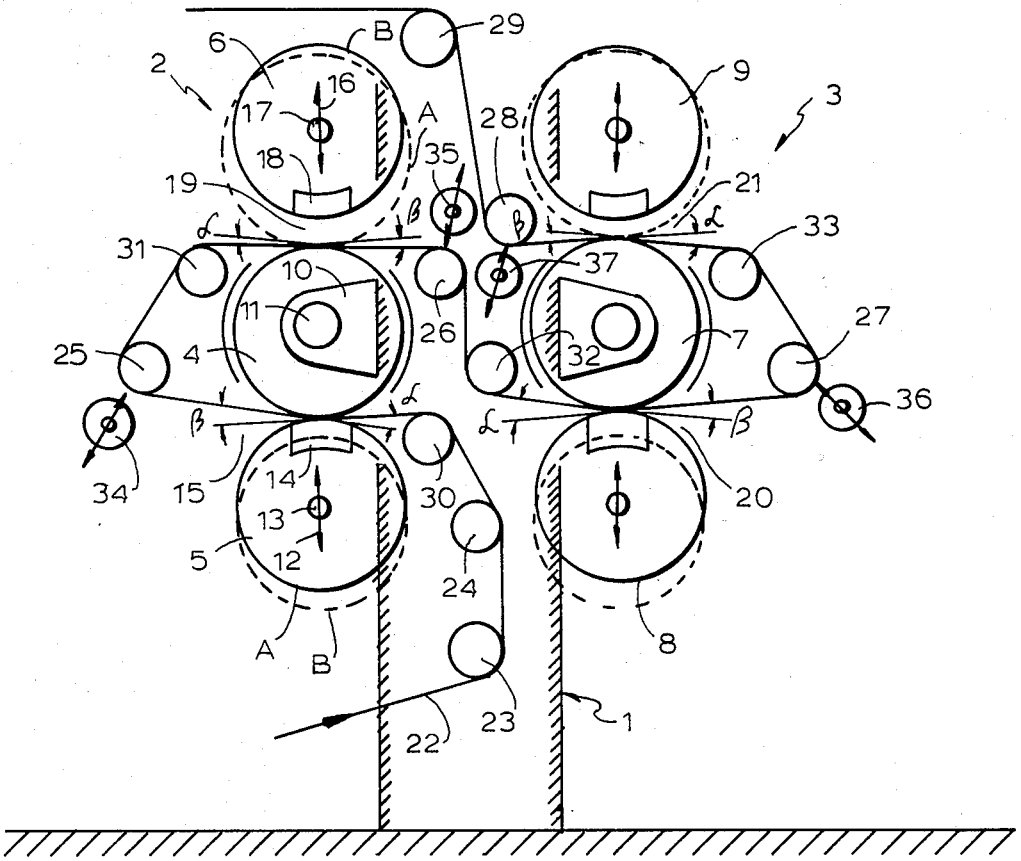
FIG. 2
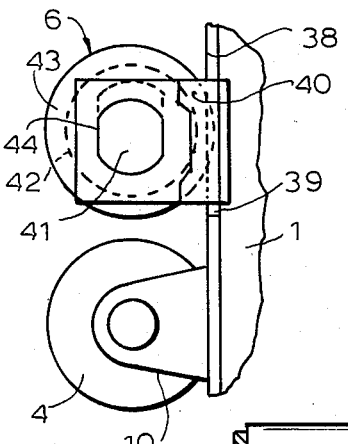
FIG. 3
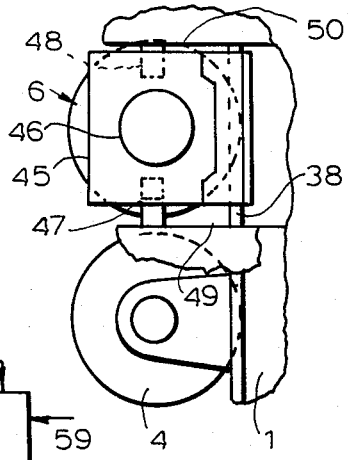
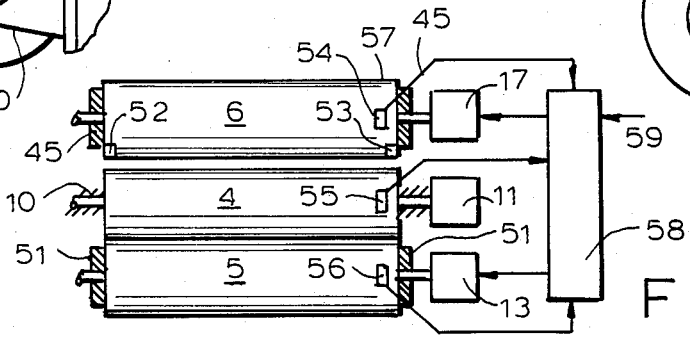
FIG. 4

METHOD OF AND ARRANGEMENT FOR PROCESSING LENGTHS OF MATERIAL

BACKGROUND OF THE INVENTION

The invention relates to a method of and an arrangement for processing lengths of material.

More particularly, the invention relates to a method of and an arrangement for calendering lengths of material, e.g., bands of paper and the like.

A known arrangement for processing lengths of material has one or more hard or inelastic processing rollers which are advantageously capable of being heated. The arrangement further includes two or more elastically deformable working rollers each of which defines a gap with the processing roller or rollers. The material to be processed travels through the gaps. The working rollers are movably mounted and a moving mechanism is provided to move the working rollers between an operative position in which they are urged against the processing roller or rollers and an inoperative position in which they are spaced from the processing roller or rollers. The processing roller or rollers are rotated at a predetermined peripheral speed during processing and the working rollers may be accelerated to such speed by means of an adjustable drive mechanism. Guide elements guide the material in such a manner that the material does not contact a working roller which is in its inoperative position, i.e., the material contacts only the processing roller when passing through a gap defined by such roller and a working roller which is in its operative position.

U.S. Pat. No. 3,254,593 discloses a calender for paper which is directly connected to a paper processing machine. In the calender, the paper passes through two units each of which is made up of a processing roller and two diametrically opposite working rollers. The paper thus travels through and is compressed in four gaps. The processing rollers are heated and one side of the paper contacts the respective processing roller in the two upstream gaps while the other side of the paper contacts the respective processing roller in the two downstream gaps. The contact areas between the paper and the processing rollers vary. The working rollers are mounted in pivotable supports and pneumatic units are provided to move the working rollers from their inoperative positions to their operative positions and to bias the working rollers towards the processing rollers. The working rollers are driven by the shafts of the processing rollers via belt drives and movable or adjustable couplings. By switching on the belt drives and adjusting the couplings, the peripheral speeds of the working rollers may be at least approximately synchronized with the peripheral speeds of the processing rollers.

The processing rollers are designated as hard or inelastic since they have jackets or shells composed of steel, hard cast iron or another hard metallic material. The working rollers are designated as elastic or elastically deformable since they are coated with an elastoviscous material, e.g., paper. The elastic working rollers are subjected to greater wear and are more prone to damage by the material being processed than the processing rollers.

Accordingly, the life of a working roller is substantially shorter than that of a processing roller. A conventional calender such as that described above must be stopped when a working roller becomes worn or damaged in order to permit replacement of the working roller. This involves a loss in production time ranging from 30 minutes to several hours. In addition, restarting of the calender entails costs which would otherwise not have been incurred.

OBJECTS AND SUMMARY OF THE INVENTION

It is an object of the invention to provide a method of and an arrangement for processing lengths of material which enable roller servicing or replacement to be effected with little or no loss in production time.

Another object of the invention is to provide a method of and an arrangement for processing lengths of material which enable roller servicing or replacement to be effected without incurring the expenses associated with a restart in processing.

An additional object of the invention is to provide a method of and an arrangement for processing lengths of material which enable roller servicing or replacement to be effected with little or no interruption in processing.

A further object of the invention is to provide a method of and an arrangement for processing lengths of material which enable roller servicing or replacement to be effected with little or no sacrifice in quality of the material being processed even though processing continues during servicing or replacement.

A concomitant object of the invention is to provide a method and an arrangement of the type described above which enable an elastic working roller to be serviced or replaced with little or no interruption in processing and little or no sacrifice in quality of the material being processed.

The preceding objects, as well as others which will become apparent as the description proceeds, are achieved by the invention.

One aspect of the invention resides in a method of processing lengths of material. The method comprises the following steps:

A. Conveying the material along a predetermined path.

B. Maintaining a first roller located in the region of a first portion of the path in a first operative position for a predetermined interval to thereby effect processing of the material in the first portion of the path. The first roller is movable from the first operative position to a first inoperative position.

C. Maintaining a second roller located in the region of a second portion of the path in a second inoperative position during the aforesaid predetermined interval. The second roller is movable to a second operative position to thereby effect processing of the material in the second portion of the path.

D. Moving the second roller to the second operative position without interrupting the conveying step.

E. Moving the first roller to the first inoperative position without interrupting the conveying step to thereby permit the first roller to be manipulated, e.g., serviced or replaced, during performance of the conveying step.

F. Maintaining the second roller in the second operative position for a preset interval following movement of the first roller to the first inoperative position.

The method of the invention is well-suited for calendering bands of paper and like materials.

The first and second rollers, which will hereinafter also be referred to as working rollers, are preferably elastically deformable. The working rollers may cooperate with a common processing roller in their operative positions or may each cooperate with a different processing roller in their operative positions. The processing roller or rollers preferably have hard or inelastic surfaces and are advantageously capable of being heated. The working rollers may be moved between their operative and inoperative positions by moving mechanisms which are designed to urge the working rollers towards the processing roller or rollers in the operative positions and to maintain the working rollers at a distance from the processing roller or rollers in the inoperative positions so that the working rollers define gaps with the processing roller or rollers. Preferably, guide elements are provided for the material being processed and guide the material in such a manner that the latter is free of contact with the working rollers in the inoperative positions but is held in engagement with the processing roller or rollers. The processing roller or rollers are rotated at a predetermined peripheral speed and an adjustable rotating mechanism may be provided to accelerate the working rollers to such speed.

The working rollers are preferably designed such that the material being processed is subjected to the same or approximately the same processing conditions by each of these rollers in the operative positions thereof.

It is preferred that the second working roller, which may also be considered as a spare working roller, be rotated in its inoperative position but at a significantly lower peripheral speed than the processing roller or rollers. The spare working roller is advantageously accelerated to the same or approximately the same peripheral speed as the processing roller or rollers before being moved to its operative position.

The first working roller is preferably moved to its inoperative position at about the same time that the spare working roller is moved to its operative position.

By maintaining a working roller in an inoperative position during normal operation, this roller may serve as a spare which is capable of very rapidly assuming the function of a working roller which is in an operative position. The spare roller is able to very rapidly assume the function of a working roller requiring servicing or replacement since the spare roller need not be physically substituted for the working roller currently in use. Furthermore, the fact that physical substitution is unnecessary makes it possible for the spare roller to assume the function of another working roller without interrupting the processing operation. Inasmuch as the working rollers may be designed to process the material under the same or approximately the same conditions, servicing or replacement of a working roller may be accomplished without substantially affecting the quality of the material. Moreover, by synchronizing the peripheral speed of the spare working roller with the peripheral speed of the processing roller or rollers before moving the spare roller to its operative position, there is little danger that the material being processed will be torn or damaged. As mentioned earlier, the spare roller may be very slowly rotated in its inoperative position. This serves to prevent gravitationally induced deformation, e.g., sagging, of the spare working roller and also causes the surface of the spare roller to be uniformly exposed to environmental influences such as, for example, the heat generated by a heated processing roller. A very low rotational speed is sufficient to accomplish these objectives. The rotational speed of the spare working roller in its inoperative position may be less than one percent of the operating speed, that is, the rotational speed of the processing roller or rollers during operation, and may even be less than the rotational speed conventionally used at the time a length of material is introduced into a processing arrangement.

According to one embodiment of the invention, the first and second working rollers are arranged to cooperate with the same processing roller in the respective operative positions. This provides a high degree of reliability that the material will be subjected to at least approximately the same processing conditions by the first and second working rollers, particularly when heated processing rollers are used.

After servicing or replacement of the first roller, it is advantageous for the first roller or its replacement to serve as a spare. This makes it possible to operate continuously even when several working rollers must be serviced or replaced one after the other. In the simplest case, two working rollers or their replacements alternately serve as spares. However, it is also possible to provide a single spare for a plurality of working rollers in operative positions and to retract the first of such working rollers to become damaged or worn with the spare. The spare working roller is advantageously held in its inoperative position in operational condition. In other words, the spare is favorably held in its inoperative position with all connections required for operation thereof complete. This makes it possible for the spare working roller to very rapidly assume the function of another working roller without damage to the material being processed.

According to another embodiment of the invention, one side of the material being processed contacts a first processing roller while the other side contacts a second processing roller. Here, it is preferred that a working roller in operative position and a spare working roller be provided for each of the processing rollers. This ensures that both sides of the material continue to be processed in the same manner as before when a roller in operative position is replaced by a spare working roller.

A further aspect of the invention resides in an arrangement for processing lengths of material. The arrangement comprises the following:

A. Means defining a predetermined path for the material and including processing roller means. The processing roller means may comprise one or more processing rollers. The processing roller or rollers are preferably hard or inelastic and are advantageously capable of being heated.

B. A first roller movable between a first inoperative position and a first operative position in which the first roller cooperates with the first processing roller means to process the material. The first roller, which may constitute a working roller, is preferably elastically deformable.

C. A second roller movable between a second inoperative position and a second operative position in which the second roller cooperates with the processing roller means to process the material. The second roller, which may again constitute a working roller, is preferably also elastically deformable. The first and second rollers are advantageously designed to process the material under the same or approximately the same conditions.

D. Moving means for moving the first and second rollers between the respective operative and inoperative positions. It is preferred that the moving means be designed to urge the first and second rollers towards the processing roller means in the respective operative positions and to maintain the first and second rollers at a distance from the processing roller means in the respective inoperative positions so that the first and second rollers define gaps with the processing roller means. The means defining the predetermined path preferably comprises guide elements arranged to guide the material in such a manner that the material is free of contact with the first and second rollers in the respective inoperative positions while being held in engagement with the processing roller means.

E. Drive means for rotating the processing roller means and the first and second rollers. The drive means is designed to rotate the processing roller means and the first and second rollers at substantially a predetermined peripheral speed for processing. The drive means includes a drive mechanism for rotating the second roller at another peripheral speed lower than the predetermined speed when the second roller is in its inoperative position. The drive mechanism is intended to permit the second roller to serve as a spare for the first roller.

The drive means may include adjustable rotating mechanisms or drive for accelerating the first and second rollers to the predetermined peripheral speed.

In accordance with the one embodiment of the invention, the drive mechanism for rotating the second or spare roller at the lower peripheral speed is constituted by a different drive unit than the adjustable rotating mechanism for accelerating the second or spare roller.

According to a further embodiment of the invention, rotation of the second or spare roller at the lower peripheral speed and acceleration of the second roller are performed by the same drive unit.

The arrangement in accordance with the invention is well-suited for performing the method of the invention.

The rollers in the arrangement according to the invention may be designed to calender lengths of material such as bands of paper and like materials.

In accordance with another embodiment of the invention, the drive mechanism for the spare working roller comprises a variable speed motor which is arranged to drive only this roller. Such a motor may be controlled by a simple regulating mechanism to achieve the desired peripheral speeds.

The drive for the spare working roller may be controlled by a regulating mechanism which is connected with a source of signals representative of a peripheral speed significantly lower than the peripheral speed of the processing roller means. The regulating mechanism is further connected with sensing devices which sense the peripheral speed of the spare working roller as well as that of the processing roller means. The sensing devices may, for example, be in the form of contactless sensors which detect marks on the peripheries of the spare working roller and the processing roller means. The regulating mechanism selectively causes the spare working roller to rotate at the peripheral speed of the processing roller means or at the significantly lower peripheral speed depending upon whether the spare working roller is in its operative or its inoperative position.

Distance measuring devices or sensors may be provided so as to enable the moving means to position the spare working roller in substantial parallelism with the processing roller means when the spare working roller is moved from its inoperative to its operative position. The distance measuring devices are preferably arranged to control the moving means in such a manner that the entire length of the spare working roller comes into contact with the processing roller means at the same time. This contributes to permitting replacement of the first roller by the second or spare working roller without substantial influence on the quality of the material being processed.

The guide elements for the material being processed are advantageously arranged in such a manner that the contact area between the material and the processing roller means in the gap defined by the latter and the first working roller is the same as the contact area in the gap defined by the processing roller means and the second or spare working roller. Since the magnitude of the contact area may influence the characteristics of the material being processed, e.g., when the processing roller means is heated, this also helps to ensure that the characteristics of the material remain substantially unchanged upon replacement of the first working roller by the spare working roller.

It is further favorable for the guide elements to be arranged in such a manner that the material being processed leaves each of the gaps defined by the processing roller means and the first and second rollers at the same angle as the material enters the respective gap. The reason is that the degree to which the quality of the material can be maintained increases as the symmetry in the gaps improves. Preferably, the sum of the angles at which the material enters and leaves a gap is at most 20 degrees. The contact area between the material and the processing roller means in each of the gaps is then relatively small. Accordingly, the quality of the material is only insignificantly influenced by contact between the material and the processing roller means in the gap defined by the latter and a working roller in inoperative position.

A guide element may be arranged immediately upstream of each gap defined by the processing roller means and the first and second rollers as well as immediately downstream of each gap. Advantageously, the two upstream guide elements have the same orientations or positions relative to the respective gaps while the two downstream guide elements likewise have the same orientations or positions relative to the respective gaps. In this manner, the same processing conditions may be obtained in both gaps.

The guide elements located immediately upstream of the gaps may be designed as movable or adjustable guide rollers. The guide rollers are advantageously arranged in such a manner that the material being processed contacts the guide rollers along an arc of less than 90 degrees. It is further preferred that the guide rollers be arranged to exert a force on the material in a direction transverse to the path of movement of the material. By way of example, the guide rollers may be of the type disclosed in German Pat. No. 20 33 740. Such guide rollers stretch the material along its width. By positioning the guide rollers immediately upstream of the gaps defined by the processing roller means and the first and second rollers, the material may be smoothly guided into the gaps. The material preferably contacts the guide rollers along an arc of less than 90 degrees in order to prevent substantial reductions in the efficiencies of the guide rollers due to frictional forces.

The guide elements located immediately downstream of the gaps defined by the processing roller means and the first and second rollers may be designed as fixedly mounted guide rollers. These fixed guide rollers determine the angles at which the material leaves the respective gaps and may be designed to change the direction of travel of the material.

A displaceable roller may be associated with each of the fixed guide rollers. Each of the displaceable rollers may be movable between an advanced position in which it is urged towards the respective fixed guide roller and a retracted position in which it is spaced from the corresponding fixed guide roller. The displaceable rollers may cooperate with the respective fixed guide rollers in the advanced positions to form advancing units for drawing lengths of material into the processing arrangement. Here, the fixed guide rollers assume an additional function. According to one embodiment of the invention, the first and second working rollers are located on diametrically opposite sides of a common processing roller and cooperate with the latter in the respective operative positions. Preferably, the drive means for the various rollers comprises an additional drive mechanism for rotating the first roller independently of the processing roller, that is, both the first and second rollers preferably have a drive mechanism for rotating the same independently of one another and of the processing roller. The drive mechanism for the first roller is advantageously capable of rotating the latter at a peripheral speed significantly lower than the peripheral speed of the processing roller. In this embodiment of the invention, the first and second working rollers may alternately serve as spares.

According to another embodiment of the invention, one or more additional working rollers are provided and are movable between respective operative positions in which they cooperate with the processing roller means to process the material and respective inoperative positions. The first and second rollers as well as the additional roller or rollers may be arranged to cooperate with a common processing roller in the respective operative positions. The second roller may then serve as a spare both for the first roller and the additional roller or rollers.

In a further embodiment of the invention, two pairs of working rollers are arranged to cooperate with a common processing roller in the respective operative positions. At least one roller of each pair has a drive mechanism which enables the same to be rotated independently of the remaining rollers so that it may serve as a spare for the other roller of the respective pair. The drive mechanisms are advantageously capable of rotating the respective rollers at a peripheral speed significantly lower than that of the processing roller.

According to an additional embodiment of the invention, the processing roller means includes a pair of processing rollers. The first working roller cooperates with one of the processing rollers in its operative position. An additional working roller movable between additional operative and inoperative positions is arranged to cooperate with the other processing roller in its operative position. The second or spare working roller is situated between, and its inoperative position is located approximately midway between, the two processing rollers. The spare working roller may be selectively moved to two operative positions in each of which it cooperates with a different one of the processing rollers. The second working roller then functions as a spare for both processing rollers.

The working rollers are advantageously constructed with compensating mechanisms for controlling deformation thereof. This enables the material to be uniformly processed across its entire width. In the embodiment of the invention where the second working roller functions as a spare for a pair of processing rollers, the compensating mechanism in the second working roller is preferably rotatable through 180 degrees.

According to another embodiment of the invention, deformation of a working roller is controlled by a pressure roller located on that side of the working roller which is remote from the processing roller means. The pressure roller may be moved between a position in which it is urged against the respective working roller and a position in which it is out of engagement with such working roller. This embodiment of the invention enables the working rollers to have simpler constructions.

When a processing roller cooperates with more than one working roller, it is preferred that the material travel consecutively through all of the gaps defined by this processing roller and its cooperating working rollers. This permits the path of movement of the material inside the processing arrangement to be relatively short. Furthermore, in the case of a processing roller which cooperates with two working rollers, this ensures that the sequence of processing operations to which the material is subjected upon replacement of one of the two working rollers by the other remains unchanged.

In accordance with a further embodiment of the invention, the processing roller means includes a pair of processing rollers. One of the processing rollers is arranged to contact a first side of the material being processed and the first working roller cooperates with this processing roller while second working roller serves as a spare for the first working roller. The other processing roller is arranged to contact the opposite side of the material. A pair of additional working rollers which are movable between respective operative and inoperative positions are associated with the latter processing roller. The drive means for the rollers comprises an additional drive mechanism for rotating one of the additional rollers independently of the remaining rollers so that this additional roller may serve as a spare for the other of the additional rollers. Preferably, the additional drive mechanism is capable of rotating the respective additional working roller at a significantly lower peripheral speed than the processing rollers. Here, a spare working roller is associated with each side of the material being processed thereby permitting the processing conditions to remain substantially the same when a working roller is replaced.

According to still another embodiment of the invention, at least one additional working roller is provided and is movable between additional operative and inoperative positions. The various working rollers are arranged at spaced locations along the path of the material being processed with the second working roller being situated at a location intermediate the first and additional working rollers. The second working roller may then replace one of the other working rollers without causing a significant change in the sequence of processing operations to which the material is subjected.

The novel features which are considered as characteristic of the invention are set forth in particular in the appended claims. The improved processing arrangement itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWINGS

FIG. 1 is a schematic end elevational view of one embodiment of a processing arrangement in accordance with the invention;

FIG. 2 is a view similar to but illustrating certain details of the arrangement shown in FIG. 1;

FIG. 3 is a view similar to but illustrating another embodiment of the details shown in FIG. 2;

FIG. 4 is a side elevational view of the processing arrangement shown in FIG. 1 but with certain elements omitted;

DESCRIPTION OF THE PREFERRED EMBODIMENTS

Figure 5:
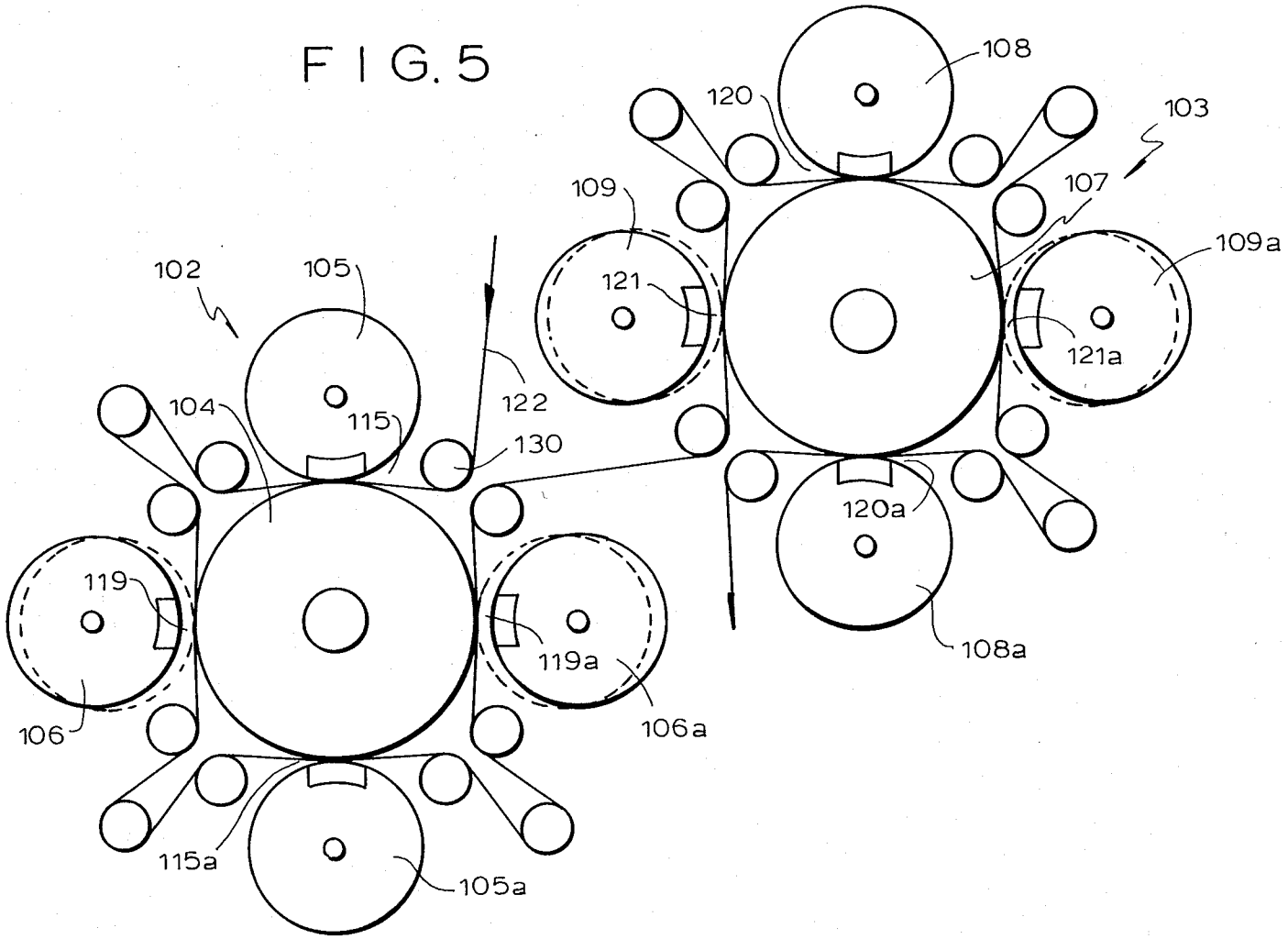
FIG. 5 is a schematic end elevational view of another embodiment of the processing arrangement according to the invention.

The processing arrangement shown in FIGS. 1–4 is here assumed to be a calendar for bands of paper and like materials.

The calender comprises a support 1 which carries two calendering or processing units 2 and 3. The calendering unit 2 includes a hard or inelastic calendering or processing roller 4, a first elastically deformable working roller 5 and a second elastically deformable working roller 6. The calendering unit 3 includes a hard or inelastic calendering or processing roller 7, a first elastically deformable working roller 8 and a second elastically deformable working roller 9. The calendering roller 4 is mounted in bearing units 10 which are fixed to the support 1. A motor 11 is connected with the calendering roller 4 and rotates the latter at a predetermined peripheral speed during a calendering operation. The motor 11 drives only the calendering roller 4. The calendering roller 4 may, if necessary, be designed so as to be capable of being heated.

As indicated in FIG. 1, the working roller 5 defines a gap or nip 15 with the calendering roller 4. A moving mechanism 12 represented by a double-headed arrow is arranged to move the working roller 5 between an operative position A indicated by a full line and an inoperative position B indicated by a dashed line. In the operative position A, the working roller 5 cooperates with the calendering roller 4 to calender a band or length of material 22 which is here assumed to be paper. The working roller 5 is constructed with a compensating mechanism 14 which makes it possible to control or compensate for deformation of the working roller 5. A motor 13 is connected with and drives only the working roller 5, that is, the motor 13 is arranged to drive the working roller 5 independently of the calendering roller 4 and the working roller 6. The motor 13 is a variable speed motor which is capable of rotating the working roller 5 at the peripheral speed attained by the calendering roller 4 during a calendering operation and is also capable of rotating the working roller 5 at a significantly lower peripheral speed, e.g., at 1 percent of the peripheral speed attained by the calendering roller 4 during a calendering operation.

The working roller 6 defines a gap or nip 19 with the calendering roller 4. A moving mechanism 16 represented by a double-headed arrow is arranged to move the working roller 6 between the operative position A which is here indicated by a dashed line and the inoperative position B which is here indicated by a full line. In the operative position A, the working roller 6 cooperates with the calendering roller 4 to calender the band 22. The working roller 6 is constructed with a compensating mechanism 18 which makes it possible to control or compensate for deformation of the working roller 6. A motor 17 is connected with and drives only the working roller 6, that is, the motor 17 is arranged to rotate the working roller 6 independently of the calendering roller 4 and the working roller 5. Like the motor 13, the motor 17 is a variable speed motor.

The calendering unit 3 is constructed in the same fashion as the calendering unit 2. The working roller 8 of the calendering unit 3 defines a gap or nip 20 with the calendering roller 7 while the calendering roller 9 of the calendering unit 3 defines a gap or nip 21 with the calendering roller 7.

The instantaneous positions of the working rollers 5, 6, 8, 9 are the positions indicated by full lines. Thus, the working rollers 5 and 8 are in their operative positions A. The moving mechanisms 12, 16 are designed in such a manner that the working rollers 5, 6, 8, 9 are urged towards the respective calendering rollers 4 and 7 in the operative positions A. Accordingly, the band 22 is compressed in the gaps 15, 19, 20, 21 when the working rollers 5, 6, 8, 9 are in the operative positions A. The working rollers 6 and 9 are shown as being in their inoperative positions B. The moving mechanisms 12, 16 are designed such that the working rollers 5, 6, 8, 9 are maintained at a distance from the respective calendering rollers 4 and 7 in the inoperative positions B. The band 22 is therefore not subjected to compression in the gaps 15, 19, 20, 21 when the working rollers 5, 6, 8, 9 are in the inoperative positions B. In the situation illustrated in FIG. 1, the band 22 is subjected to compression in the gaps 15 and 20 but not in the gaps 19 and 21.

The calender includes a set of fixed guide rollers 23–29 as well as a set of movable or adjustable guide rollers 30–33. The guide rollers 23–33 cooperate with the calendering rollers 4, 7 to define the path of travel of the band 22. The path of travel of the band 22 is such that the band 22 passes consecutively through the gaps 15 and 19 associated with the calendering roller 4 and then passes consecutively through the gaps 20 and 21 associated with the calendering roller 7. In other words, the path of travel of the band 22 has an upstream segment which contains the gaps 15 and 19 defined by the calendering roller 4 but neither of the gaps 20 and 21 defined by the calendering roller 7 and a downstream segment which contains the gaps 20 and 21 but neither of the gaps 15 and 19. The guide rollers 23–33 are arranged in such a manner that the band 22 does not engage the working rollers 5, 6, 8, 9 when the latter are in the inoperative positions B.

Each of the adjustable guide rollers 30–33 is arranged immediately upstream of a respective gap 15, 19, 20, 21. The adjustable guide rollers 30–33 may, for example, be designed as deflecting rollers or as stretching rollers which stretch the band 22 along its width. In other words, it is possible to design the adjustable guide rollers 30–33 so as to exert a force on the band 22 in a direction transverse to the direction of travel of the band 22. The guide rollers 23–33 are arranged in such a manner that the band 22 contacts each of the adjustable guide rollers 30–33 along an arc of less than 90 degrees.

Each of the fixed guide rollers 25–28 is located immediately downstream of a respective gap 15, 19, 20, 21. Displaceable rollers 34–37 are respectively associated with the fixed guide rollers 25–28. As indicated by the double-headed arrows, each of the displaceable rollers 34–37 is movable between an advanced position in which it is urged against the respective fixed guide roller 25–28 and a retracted position in which it is spaced apart from the associated fixed guide roller 25–28. The displaceable rollers 34–37 and the associated fixed guide rollers 25–28 together define respective advancing units for introducing or threading the band 22 into the calender. The displaceable rollers 34–37 are driven in rotation by non-illustrated drive units.

Each of the adjustable guide rollers 30–33 has the same position or orientation relative to the respective gap 15, 19, 20, 21 located immediately downstream of the same. Similarly, each of the fixed guide rollers 25–28 has the same position or orientation relative to the respective gap 15, 19, 20, 21 located immediately upstream of the same. Accordingly, the band 22 enters each of the gaps 15, 19, 20, 21 at the same angle alpha and leaves each of the gaps at the same angle beta. Furthermore, the contact area between the band 22 and the calendering roller 4 in each of the gaps 15, 19 defined by the calendering roller 4 is the same. Likewise, the contact area between the band 22 and the calendering roller 7 is the same in each of the gaps 20, 21 defined by the calendering roller 7. It is preferred that the fixed guide rollers 25–28 and the adjustable guide rollers 30–33 be arranged in such a manner that alpha and beta are equal. Moreover, the sum of alpha and beta is advantageously no greater than 20 degrees.

In FIG. 1, the geometry is the same for all of the gaps 15, 19, 20, 21. This is not necessary for successful calendering of the bands 22 in accordance with the invention. However, it is desirable that the geometry for the gap 15 defined by the calendering roller 4 be the same as that for the gap 19 defined by the calendering roller 4. The reason is that this makes it possible for the band 22 to be calendered under the same conditions in the gaps 15 and 19 so that the quality of the band 22 is substantially the same regardless of whether the working roller 5 or the working roller 6 is in the operative position A. Similarly, it is desirable that the geometry for the gap 20 defined by the calendering roller 7 be the same as that for the gap 21 defined by the calendering roller 7.

FIG. 2 illustrates one embodiment of the moving mechanisms 12, 16 for moving the working rollers 5, 6, 8, 9 between the operative positions A and the inoperative positions B. Of the working rollers 5, 6, 8, 9, only the roller 6 is shown in order to preserve clarity.

In FIG. 2, the support 1 of the calender is formed with a pair of vertically extending guide elements or guide surfaces 38 which are spaced in the longitudinal direction of the working roller 6. Each of the guide elements 38 is provided with an abutment 39. A carrier 40 is guided by each guide element 38 and the carriers 40 are held in fixed positions against the abutments 39. By way of example, the carriers 40 may be urged against the abutments 39 via non-illustrated hydraulic units which exert downward forces on the carriers 40 from above.

The working roller 6 comprises a core 41 which is non-rotatably supported at either end by the carriers 40. One or more bearings 42 are mounted on the core 41 and rotatably support a roller jacket 43. The bearing or bearings 42 are mounted on the core 41 for sliding movement relative to the latter in a vertical direction and are guided for such movement by guide means 44. The bearing or bearings 42 are arranged to be moved up-and-down on the core 41 by the compensating mechanism 18 which may, for example, comprise a plurality of hydraulic or pneumatic units.

A structure of the type described with reference to FIG. 2 is disclosed, for instance, in the German Offenlegungsschrift No. 30 04 915.

Another embodiment of the moving mechanisms 12, 16 is illustrated in FIG. 3 where, again, the working roller 6 is the only one of the working rollers 5, 6, 8, 9 to be shown.

In FIG. 3, the working roller 6 has a shaft 46 which is rotatably supported at either end by a carrier 45. The carriers 45 are vertically movable and are guided for vertical movement by the guide elements 38 of the support 1. Each of the carriers 45 is equipped with a pair of piston-and-cylinder units 47 and 48. The piston-and-cylinder units 47, 48 have short strokes and may, for example, be of the type disclosed in U.S. patent application Ser. No. 323,095 of Gerhard Hartwich et al. filed Nov. 19, 1981. The piston of the piston-and-cylinder unit 47 bears against a fixed surface 49 while the piston of the piston-and-cylinder unit 48 bears against a fixed surface 50. The working roller 6 may be moved between the operative and inoperative positions A and B by selectively activating the piston-and-cylinder units 47, 48.

The moving mechanisms illustrated in FIGS. 2 and 3 may be used for the working rollers 5, 8, 9 as well as the working roller 6. As shown in FIG. 4, the working roller 5 may, for example, be mounted on vertically movable carriers 51 which are equipped with piston-and-cylinder units such as the piston-and-cylinder units 47, 48, that is, which are equipped with piston-and-cylinder units having short strokes.

Referring to FIG. 4, the working roller 6 is equipped with a pair of distance measuring devices 52 and 53 which are located at opposite ends thereof. The distance measuring devices 52, 53 sense the distance between the working roller 6 and the calendering roller 4. This makes it possible to arrange the working roller 6 parallel to the calendering roller 4 when the working roller 6 is moved from the inoperative position B to the operative position A. The distance measuring devices 52, 53 may be designed to control the moving mechanism 16 for the working roller 6, e.g., the piston-and-cylinder units or hydraulic units 47, 48, in such a manner that the working roller 6 is positioned precisely parallel to the calendering roller 4 upon being moved to the operative position A.

The working rollers 5, 8, 9 may likewise be provided with distance measuring devices. With reference still to FIG. 4, a contactless sensor 55 is situated in the region of the calendering roller 4 while contactless sensors 56 and 54 are respectively situated in the regions of the working rollers 5 and 6. The sensors 54–56 are designed to detect marks 57 on the peripheral surfaces of the rollers 4–6 and to generate signals in response to detection of the marks 57. The signals generated by the sensors 54–56 are indicative of the peripheral speeds of the rollers 4–6.

The signals from the sensors 54–56 are delivered to a computer 58. Additional signals representative of a peripheral speed significantly lower than the peripheral speed of the calendering roller 4 during a processing operation are delivered to the computer 58 from a signal source 59.

The computer 58 is connected with the motors 13, 17 for the working rollers 5, 6. The computer 58 evaluates the signals from the sensors 54–56 to establish the peripheral speeds of the rollers 4, 6 and regulates the motors 13 and 17 accordingly.

In operation, the motor 11 drives the calendering roller 4 at a predetermined peripheral speed during calendering of the band 22. Assuming that the working roller 5 is in the operative position A and the working roller 6 is in the inoperative position B as shown in FIG. 1, the computer 58 causes the motor 13 to rotate the working roller 5 at a peripheral speed which equals that of the calendering roller 4 or differs therefrom by a small, well-defined amount. To this end, the computer 58 compares the signals from the sensors 55 and 56. On the other hand, the computer 58 causes the motor 17 to rotate the working roller 6 at a peripheral speed which is significantly lower than the peripheral speed of the calendering roller 4, e.g. at a peripheral speed equal to 1 percent of the peripheral speed of the calendering roller 4. This is achieved in that the computer 58 compares the signals from the sensor 54 with the signals from the source 59.

The working roller 6 is rotated at a low peripheral speed as long as it is to be maintained in the inoperative position B. When the working roller 6 is to be moved to the operative position A, the signals from the sensor 54 are compared with those from the sensor 55 which are representative of the peripheral speed of the calendering roller 4. The computer 58 then causes the motor 17 to accelerate the working roller 6 to a peripheral speed which equals or approximates that of the calendering roller 4.

Upon a determination that the working roller 5 has become damaged during operation, the working roller 6 which has been held in readiness in the inoperative position B is accelerated by the motor 17 to a peripheral speed equalling or approximating that of the calendering roller 4. Once the working roller 6 has been accelerated, it is moved to the operative position A by means of the moving mechanism 16. At the same time, the working roller 5 is moved from the operative position A to the inoperative position B. The working roller 6 thus almost immediately assumes the function of the working roller 5 so that calendering of the band 22 in the calendering unit 2 continues virtually without interruption.

Once the working roller 5 has been moved to the inoperative position B, the working roller 5 may be removed and replaced with a fresh working roller. The latter may then be maintained in readiness in the inoperative position B as a spare for the working roller 6. Alternatively, the working roller 5 may be serviced while in the inoperative position B and thereafter held in the inoperative position B in readiness as a spare for the working roller 6.

The working roller 6 is maintained in the inoperative position B in operational condition while the working roller 5 is in use. In other words, the working roller 6 is connected with all of the systems necessary for its operation while the working roller 6 is held in the inoperative position B. These systems include the pressure system for moving the working roller 6 to the operative position A; the energy and control systems for the compensating mechanism 18; and the motor 17. Accordingly, substitution of the worker roller 6 for the working roller 5 takes place very rapidly. The processing conditions for the band 22 are not substantially affected by this substitution since the geometries in the regions of the gaps 15 and 19 are identical and since the working roller 6 is moved to the operative position A only after the peripheral speed thereof is the same or approximately the same as that of the calendering roller 4.

It will be observed that the calendering rollers 4 and 7 contact opposite sides of the band 22.

In FIG. 5, the same reference numerals as in FIG. 1 but increased by 100 are used to identify similar elements. The calendering arrangement of FIG. 5 includes a pair of calendering units 102 and 103. The calendering unit 102 comprises a calendering roller 104 as well as a pair of first working rollers **105, 105*a* and a pair of second working rollers 106, 106*a*. The working rollers 105, 105*a* are located diametrically opposite each other as are the working rollers 106, 106*a*. Each of the rollers 105, 105*a*, 106, 106*a* is movable between an operative position in which it cooperates with the calendering roller 104 to calender the band 122 and an inoperative position. The working rollers 105, 105*a* are in their operative positions while the working rollers 106, 106*a*** are in their inoperative positions.

The calendering unit 103 includes a calendering roller 107 as well as a pair of first working rollers **108, 108*a* and a pair of second working rollers 109, 109*a*. The working rollers 108, 108*a* are located diametrically opposite one another as are the working rollers 109, 109*a*. Each of the working rollers 108, 108*a*, 109, 109*a* is movable between an operative position in which it cooperates with the calendering roller 107 to calender the band 122 and an inoperative position. The working rollers 108, 108*a* are in their operative positions while the working rollers 109, 109*a*** are in their inoperative positions.

In the illustrated condition of the calendering arrangement shown in FIG. 5, the band 122 is calendered or compressed in the gaps or nips **115, 115*a*, 120, 120*a* but passes freely through the gaps or nips 119, 119*a*, 121, 121*a*. Guide rollers, of which only the guide roller 130 is identified by a reference numeral guide the band 122 in such a manner that the band 122 alternately passes through gaps 115, 115*a*, 120, 120*a* in which it is compressed and gaps 119, 119*a*, 121, 121*a*** in which it travels freely.

The calendering rollers 104 and 107 contact opposite sides of the band 122.

The processing arrangement of FIG. 5 enables a relatively large number of gaps for calendering a band to be situated in a relatively small space.

Figure 6:
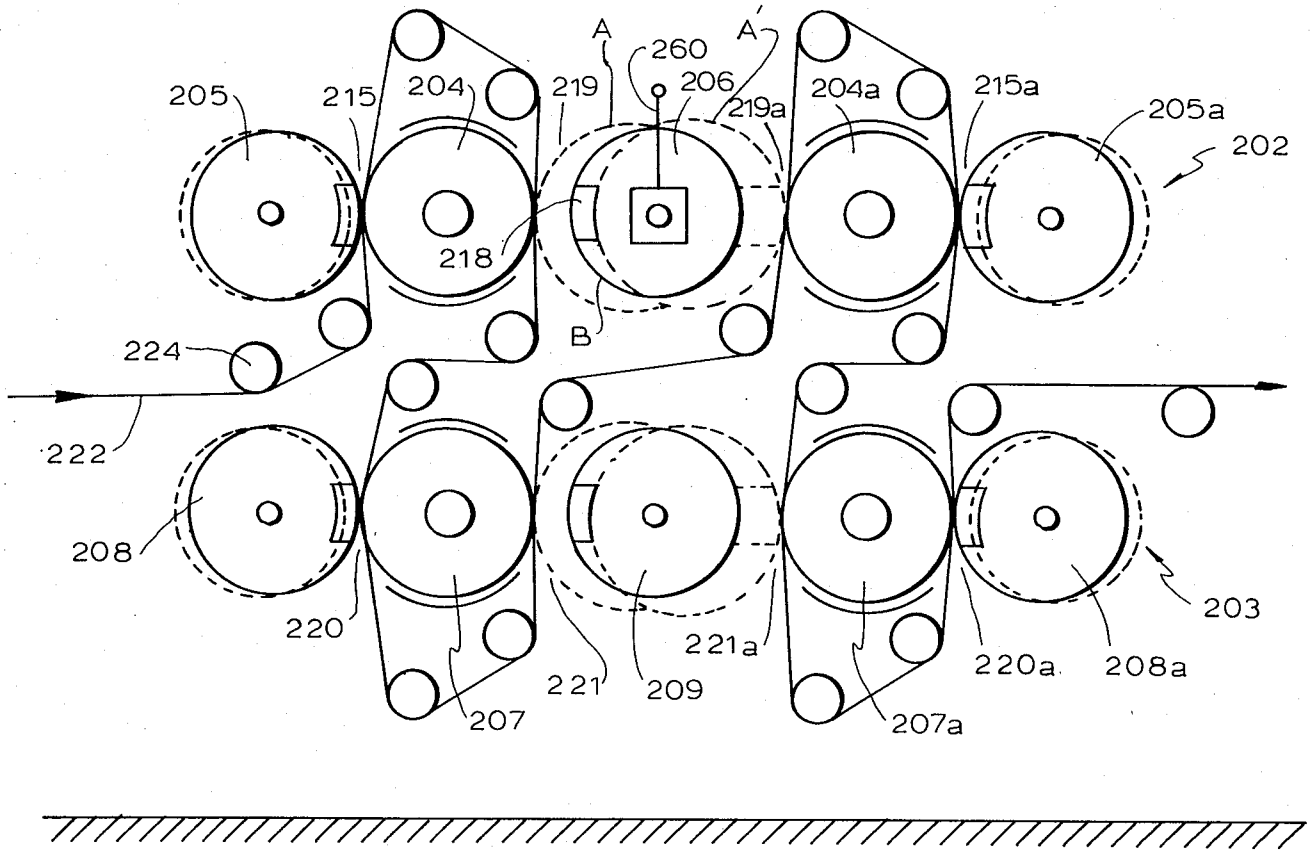
FIG. 6 is a schematic end elevational view of a further embodiment of the processing arrangement in accordance with the invention.

In FIG. 6, the same reference numerals as in FIG. 1 but increased by 200 are used to identify similar elements.

The calendering arrangement of FIG. 6 has a calendering unit 202 which comprises two calendering rollers 204 and **204*a*. A first working roller 205 movable between operative and inoperative positions is arranged to cooperate with the calendering roller 204 while an additional first working roller 205*a*, which is also movable between operative and inoperative positions, is arranged to cooperate with the calendering roller 204*a*. A second working roller 206 is located between the calender rollers 204 and 204*a***.

The calendering arrangement of FIG. 6 further has a calendering unit 203 which is similar to the calendering unit 202. The calendering unit 203 includes a pair of calendering rollers 207 and 207*a*. A first working roller 208 movable between operative and inoperative positions is arranged to cooperate with the calendering roller 207 while an additional first working roller 208*a*, which is likewise movable between operative and inoperative positions, is arranged to cooperate with the calendering roller 207*a*. A second working roller 209 is located between the calendering rollers 207 and 207*a*.

With reference to the calendering unit 202, the working roller 206 has an inoperative position B which is located midway between the calendering rollers 204 and 204*a*. The working roller 206 can be moved from the inoperative position B to the left in order to assume the operative position A. In the operative position A, the working roller 206 assumes the function of the working roller 205 and cooperates with the calendering roller 204 to calender the band 222. The working roller 206 can also be moved to the right from the inoperative position B in order to assume the operative position A'. In the operative position A', the working roller 206 assumes the function of the working roller 205*a* and cooperates with the calendering roller 204*a* to calender the band 222.

The working roller 206 is constructed with a compensating mechanism 218 in order to control or compensate for deformation thereof. The compensating mechanism 218 must be capable of operating in different directions. Accordingly, a rotating device 260 is provided to rotate the compensating mechanism 218 and its support or carrier through an angle of 180 degrees.

In the illustrated condition of the calendering arrangement shown in FIG. 6, the working rollers 205, 205*a*, 208, 208*a* are in their operative positions while the working rollers 206, 209 are in their inoperative positions. The band 222 is thus calendered or compressed in the gaps or nips 215, 215*a*, 220, 220*a* but freely passes through the gaps or nips 219, 219*a*, 221, 221*a*. Guide rollers, of which only the guide roller 224 is identified by a reference numeral, guide the band 222 in such a manner that the band 222 alternately passes through gaps 215, 215*a*, 220, 220*a* in which it is compressed and gaps 219, 219*a*, 221, 221*a* in which it travels freely.

Figure 7:
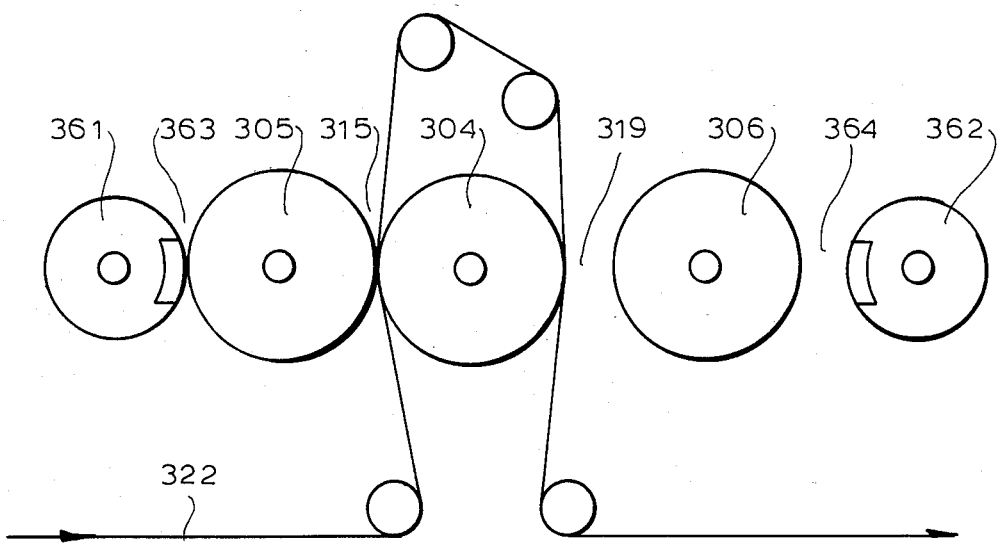
FIG. 7 is a schematic end elevational view of an additional embodiment of the processing arrangement according to the invention.

In FIG. 7, the same reference numerals as in FIG. 1 but increased by 300 are used to identify similar elements.

The calendering arrangement of FIG. 7 comprises a calendering roller 304, a first working roller 305 and a second working roller 306. The working rollers 305 and 306 are movable between respective operative and inoperative positions. In the operative positions, the working rollers 305 and 306 cooperate with the calendering roller 304 to calendar the band 322.

The working roller 205 is not contructed with a compensating mechanism which enables deformation thereof to be compensated for or controlled. Instead, a pressure roller 361 is provided to control or compensate for deformation of the working roller 305. The pressure roller 361 presses the working roller 305 against the calendering roller 304 when the working roller 305 is in its operative position. The pressure roller 361 is located on the side of the working roller 305 remote from the calendering roller 304.

Similarly, the working roller 306 lacks a compensating mechanism which permits deformation of the working roller 306 to be compensated for or controlled. Again, a pressure roller 362 is provided to compensate for or control deformation of the working roller 306. The pressure roller 362, which is situated on the side of the working roller 306 remote from the calendering roller 304, is arranged to press the working roller 306 against the calendering roller 304 when the working roller 306 is in its operative position.

In the illustrated condition of the calendering arrangement shown in FIG. 7, the working roller 305 is in its operative position while the working roller 306 is in its inoperative position. The band 322 is thus calendered or compressed in the gap or nip 315 but freely passes through the gap or nip 319.

The working roller 305 defines a gap 363 with the pressure roller 361. Likewise, the working roller 306 defines a gap 364 with the pressure roller 362. It is possible to guide the band 322 in such a manner that it passes through the gaps 363 and 364 as well as the gaps 315 and 319.

Figure 8:
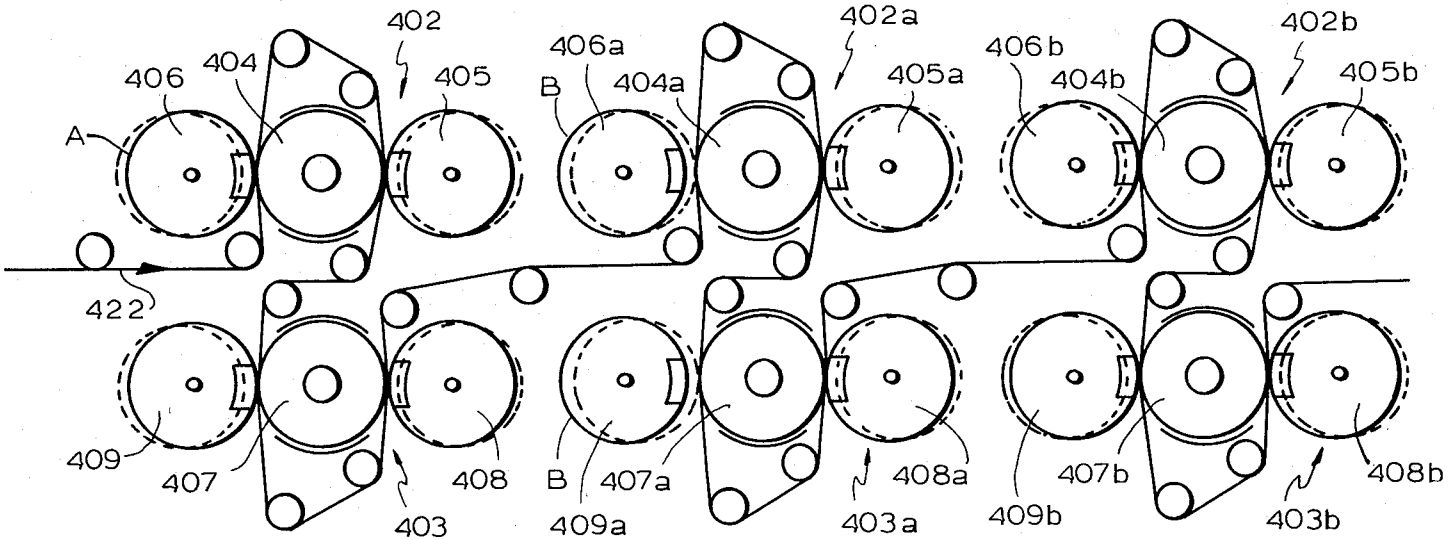
FIG. 8 is a schematic end elevational view of yet another embodiment of the processing arrangement in accordance with the invention.

In FIG. 8, the same reference numerals as in FIG. 1 but increased by 400 are used to identify similar elements.

The calendering arrangement of FIG. 8 has six calendering units, namely, the calendering units 402, 403; 402*a*; 403*a*; and 402*b*, 403*b*. The calendering unit 402 includes a calendering roller 404 as well as a pair of working rollers 405, 406 which are movable between operative positions in which they cooperate with the calendering roller 404 and inoperative positions; the calendering unit 402*a* comprises a calendering roller 404*a* as well as a pair of working rollers 405*a*, 406*a* which are movable between operative positions in which they cooperate with the calendering roller 404*a* and inoperative positions: and the calendering unit 402*b* includes a calendering roller 404*b* as well as a pair of working rollers 405*b*, 406*b* which are movable between operative positions in which they cooperate with the calendering roller 404*b* and inoperative positions.

The calendering unit 403 comprises a calendering roller 407 as well as a pair of working rollers 408, 409 which are movable between operative positions in which they cooperate with the calendering roller 407 and inoperative positions; the calendering unit 403*a* includes a calendering roller 407*a* as well as a pair of working rollers 408*a*, 409*a* which are movable between operative positions in which they cooperate with the calendering roller 407*a* and inoperative positions; and the calendering unit 403*b* comprises a calendering roller 407*b* as well as a pair of working rollers 408*b*, 409*b* which are movable between operative positions in which they cooperate with the calendering roller 407*b* and inoperative positions.

The calendering rollers 404, 404*a*, 404*b* of the calendering units 402, 402*a*, 402*b* all contact one side of the band 422. On the other hand, the calendering rollers 407, 407*a*, 407*b* of the calendering units 403, 403*a*, 403*b* all contact the opposite side of the band 422. The band 422 is guided through the calendering arrangement of FIG. 8 in such a manner that the opposite sides thereof alternately contact a processing roller 404, 404*a*, 404*b*, 407, 407*a*, 407*b*. Thus, the band 422 sequentially passes through the calendering units 402, 403, 402*a*, 403*a*, 402*b*, 403*b*.

In the calendering arrangement of FIG. 8, only the working rollers 406*a*, 409*a* of the two middle calendering units 402*a*, 403*a* are maintained in the inoperative positions B during normal operation. All of the remaining working rollers 405, 405*a*, 405*b*, 406, 406*b*, 408, 408*a*, 408*b*, 409, 409*b* are in the operative positions A and thus function to calender or compress the band 422 so that the latter is subjected to an intensive treatment. The working roller 406*a* may serve as a spare for any of the working rollers 405, 405*a*, 405*b*, 406, 406*b* of the calendering units 402, 402*a*, 402*b* while the working roller 409*a* may serve as a spare for any of the working rollers 408, 408*a*, 408*b*, 409, 409*b* of the calendering units 403, 403*a*, 403*b*. Since the band 422 is calendered or compressed in a total of 10 gaps, there is little effect on the quality of the band 422 when the spare working roller 406*a*, 409*a* and the working roller, e.g. 405*b*, 408*b*, being replaced do not directly follow one another along the path of travel of the band 422 as long as the spare working roller 406*a*, 409*a* and the working roller, e.g. 405*b*, 408*b* being replaced calender the same side of the band 422.

As may be seen from a comparison of FIGS. 1 and 6, for example, the rollers in a calendering unit may be arranged one above the other in a vertical line or next to one another in a horizontal line. Other arrangements for the rollers in a calendering unit are also possible.

As pointed out earlier, the calendering rollers may be heated. A suitable heating system for the processing rollers is disclosed, for instance, in the German Offenlegungsschrift No. 28 14 244.

In the embodiments of FIGS. 1–6 and 8, the working rollers are constructed with compensating mechanisms to control or compensate for deformation thereof. The compensating mechanisms may, for example, be of the type disclosed in German Offenlegungsschrift No. 30 22 491.

The distance between a working roller and a calendering roller when the working roller is in its inoperative position need not be excessively large. It is sufficient when the distance between a calendering roller and a working roller in its inoperative position is that which is required to feed a band into and through a calendering arrangement.

It is not necessary to employ marks on the rollers and sensors in order to determine the rotational speeds of the rollers. Instead, the rotational speeds may be calculated with the aid of a computer from the outer diameters of the rollers and the number of revolutions per unit of time.

It is preferred that all of the working rollers in a calendering arrangement according to the invention be designed to serve as spares. In many cases, however, it suffices for only a few, or even one, of the working rollers to be equipped with the means necessary for them to serve as spares.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of processing lengths of material comprising the steps of conveying said material along a predetermined path; maintaining a first roller located at the region of a first portion of said path in a first operative position for a predetermined interval to thereby effect processing of said material in said first portion of said path, said first roller being movable from said first operative position to a first inoperative position; rotating said first roller at a predetermined peripheral speed in the course of said maintaining step; maintaining a second roller located in the region of a second portion of said path in a second inoperative position during said predetermined interval, said second roller being movable to a second operative position to thereby effect processing of said material in said second portion of said path; rotating said second roller at a peripheral speed significantly lower than said predetermined speed while said second roller is maintained in said second inoperative position; moving said second roller to said second operative position without interrupting the conveying step; accelerating said second roller to said predetermined speed not later than when said second roller reaches said second operative position; moving said first roller to said first inoperative position without interrupting the conveying step to thereby permit said first roller to be manipulated during performance of the conveying step; and maintaining said second roller in said second operative position for an interval following movement of said first roller to said first inoperative position.

2. The method of claim 1, wherein said first and second rollers effect processing of said material under similar conditions.

3. The method of claim 1, wherein the accelerating step is performed prior to the step of moving said second roller to said second operative position.

4. The method of claim 1, comprising the step of replacing said first roller subsequent to the step of moving said first roller to said first inoperative position.

5. The method of claim 1, wherein the step of moving said second roller to said second operative position is performed approximately concurrently with the step of moving said first roller to said first inoperative position.

6. The method of claim 1, wherein said first and second rollers effect calendering of said material.

7. The method of claim 1, wherein the steps of maintaining said first and second rollers in said first and second operative positions comprise urging said first and second rollers into engagement with said material.

8. The method of claim 7, wherein the steps of maintaining said first and second rollers in said first and second operative positions comprise compressing said material against at least one substantially inelastic processing surface.

9. The method of claim 8, further comprising the step of rotating said surface at said predetermined peripheral speed.

10. The method of claim 1, further comprising the step of heating said material in said first and second portions of said path.

11. The method of claim 1, further comprising the step of guiding said material in such a manner that the latter is free of contact with said first and second rollers in said first and second inoperative positions.

12. The method of claim 1, wherein said first and second rollers have elastically deformable surfaces.

13. The method of claim 1, wherein the steps of maintaining said first and second rollers in said first and second operative positions comprise urging said first and second rollers towards a common processing roller designed to process said material in cooperation with said first and second rollers.

14. The method of claim 1, further comprising the steps of replacing said first roller with a fresh roller subsequent to the step of moving said first roller to said first inoperative position; and maintaining said fresh roller in said first inoperative position for an additional interval.

15. The method of claim 1, further comprising the step of replacing said first roller with a fresh roller subsequent to the step of moving said first roller to said first inoperative position; and wherein the maintaining, moving and replacing steps are repeated to alternately replace said second and fresh rollers and the respective replacements thereof.

16. The method of claim 1, wherein said second roller is maintained in said second inoperative position in operational condition.

17. The method of claim 1, wherein the maintaining and moving steps are performed for two additional rollers respectively located in the regions of two additional portions of said path, one side of said material being processed in said first and second portions of said path and the other side of said material being processed in said additional portions of said path.

18. An arrangement for processing lengths of material, comprising means defining a predetermined path for the material and including processing roller means; a first roller movable between a first inoperative position and a first operative position in which said first roller cooperates with said roller means to process the material; a second roller movable between a second inoperative position and a second operative position in which said second roller cooperates with said roller means to process the material, said processing roller means and said first and second rollers respectively defining first and second gaps, said defining means further including a first guide element immediately upstream of each of said gaps and a second guide element immediately downstream of each of said gaps, said first guide elements having substantially the same positions relative to the respective gaps and said second guide elements having substantially the same positions relative to the respective gaps; moving means for moving said first and second rollers between the respective operative and inoperative positions; and drive means for rotating said roller means and said rollers, said drive means being designed to rotate said roller means and said rollers at substantially a predetermined peripheral speed for processing, and said drive means including a drive mechanism for rotating said second roller at another peripheral speed lower than said predetermined speed when said second roller is in said second inoperative position.

19. The arrangement of claim 18, wherein said other speed is a small fraction of said predetermined speed.

20. The arrangement of claim 18, wherein said first and second rollers are designed to process the material under similar conditions.

21. The arrangement of claim 18, wherein said roller means and said rollers are designed to calender the material.

22. The arrangement of claim 18, wherein said roller means is heated.

23. The arrangement of claim 18, wherein said roller means has a substantially inelastic surface.

24. The arrangement of claim 18, wherein said rollers have elastically deformable surfaces.

25. The arrangement of claim 18, wherein said moving means is designed to urge said rollers towards said roller means in the respective operative positions.

26. The arrangement of claim 18, said moving means being designed such that said rollers are spaced from said roller means in the respective inoperative positions; and wherein said defining means is arranged to guide the material in such a manner that the latter is free of contact with said rollers in the respective inoperative positions while being held in engagement with said roller means.

27. The arrangement of claim 18, wherein said drive means further comprises adjustable rotating means for rotating said rollers at substantially said predetermined speed.

28. The arrangement of claim 18, wherein said drive mechanism comprises a variable speed motor arranged to drive said second roller only.

29. An arrangement for processing lengths of material, comprising means defining a predetermined path for the material and including roller means; a first roller movable between a first inoperative position and a first operative position in which said first roller cooperates with said roller means to process the material; a second roller movable between a second inoperative position and a second operative position in which said second roller cooperates with said roller means to process the material; moving means for moving said first and second rollers between the respective operative and inoperative positions; drive means for rotating said roller means and said rollers, said drive means being designed to rotate said roller means and said rollers at substantially a predetermined peripheral speed for processing, and said drive means including a drive mechanism for rotating said second roller at another peripheral speed lower than said predetermined speed when said second roller is in said inoperative position; sensing means for sensing the peripheral speeds of said roller means and said second roller and generating first signals representative of such peripheral speeds, a source of second signals representative of a constant peripheral speed; and regulating means for said drive mechanism arranged to receive said signals and to permit selective rotation of said second roller at substantially the peripheral speed of said roller means and at said constant peripheral speed.

30. The arrangement of claim 29, wherein said sensing means comprises contactless sensors.

31. The arrangement of claim 18, wherein said moving means is designed to permit said first and second rollers to be positioned in substantial parallelism with said roller means in the respective operative positions.

32. An arrangement for processing lengths of material, comprising means defining a predetermined path for the material and including processing roller means; a first roller movable between a first inoperative position and a first operative position in which said first roller cooperates with said roller means to process the material; a second roller movable between a second inoperative position and a second operative position in which said second roller cooperates with said roller means to process the material; moving means for moving said first and second rollers between the respective operative and inoperative positions, said moving means being designed to permit said first and second rollers to be positioned in substantial parallelism with said roller means in the respective operative positions; measuring means for measuring the distances between said roller means and each of said first and second rollers, said measuring means being designed to detect the positions in which said first and second rollers are substantially parallel to said roller means; and drive means for rotating said roller means and said rollers, said drive means being designed to rotate said roller means and said rollers at substantially a predetermined peripheral speed for processing, and said drive means including a drive mechanism for rotating said second roller at another peripheral speed lower than said predetermined speed when said second roller is in said second inoperative position.

33. The arrangement of claim 18, wherein said defining means is arranged to guide the material in such a manner that the contact area between the material and said roller means is substantially the same in each of said gaps.

34. The arrangement of claim 18, wherein said defining means is arranged to guide the material in such a manner that the material enters each gap at substantially the same angle as the material leaves such gap.

35. The arrangement of claim 20, wherein said defining means is arranged to guide the material in such a manner that the sum of the angles at which the material enters and exits each gap is at most 20°.

36. The arrangement of claim 29, said first and second rollers respectively defining first and second gaps with said roller means; and wherein said defining means comprises a first guide element immediately upstream of each gap and a second guide element immediately downstream of each gap, said first guide elements having substantially the same positions relative to the respective gaps, and said second guide elements also having substantially the same positions relative to the respective gaps.

37. The arrangement of claim 18, wherein said first guide elements are designed to exert a force on the material in a direction transverse to said path.

38. The arrangement of claim 37, wherein said guide elements are adjustable.

39. The arrangement of claim 37, wherein said guide elements comprise guide rollers.

40. The arrangement of claim 39, wherein said defining means is designed in such a manner that the material contacts said guide rollers along an arc of less than 90°.

41. The arrangement of claim 29, said first and second rollers respectively defining first and second gaps with said roller means; and wherein said defining means comprises a guide element immediately downstream of each gap.

42. The arrangement of claim 18, wherein said second guide elements are fixed.

43. The arrangement of claim 18, wherein said second guide elements comprise guide rollers.

44. The arrangement of claim 43, further comprising a pair of additional rollers each of which is designed to advance the material in cooperation with one of said second guide rollers.

45. The arrangement of claim 44, wherein said additional rollers are movable between a retracted position and an advanced position in which said additional rollers cooperate with the respective guide rollers to advance the material.

46. The arrangement of claim 18, wherein said roller means comprises a processing roller which cooperates with said first roller in said first operative position and with said second roller in said second operative position.

47. The arrangement of claim 46, wherein said first and second rollers are located on diametrically opposite sides of said processing roller.

48. The arrangement of claim 46, wherein said drive means comprises an additional drive mechanism for rotating said first roller at a peripheral speed lower than said predetermined speed when said first roller is in said first inoperative position.

49. The arrangement of claim 48, wherein said additional drive mechanism is designed to rotate said first roller at a peripheral speed which is a small fraction of said predetermined speed when said first roller is in said first inoperative position.

50. The arrangement of claim 46, comprising at least one further roller movable between a further inoperative position and a further operative position in which said further roller cooperates with said processing roller to process the material.

51. The arrangment of claim 18, wherein said roller means comprises a pair of processing rollers, one of said processing rollers cooperating with said first roller in said first operative position and with said second roller in said second operative position; and further comprising at least one further roller movable between a further inoperative position and a further operative position in which said further roller cooperates with the other of said processing rollers to process the material, said second roller being movable from said second inoperative position to a further second operative position in which said second roller cooperates with said other processing roller to process the material.

52. The arrangement of claim 51, wherein said second roller is located between said processing rollers.

53. The arrangement of claim 52, wherein said second inoperative position is substantially midway between said processing rollers.

54. The arrangement of claim 51, wherein said second roller comprises compensating means for controlling deformation thereof, said compensating means being rotatable through 180°.

55. The arrangement of claim 18, wherein at least one of said first and second rollers comprises compensating means for controlling deformation thereof.

56. The arrangement of claim 18, further comprising compensating means adjacent at least one of said first and second rollers for controlling deformation of said one roller.

57. The arrangement of claim 56, wherein said compensating means comprises a pressure roller.

58. The arrangement of claim 56, wherein said roller means comprises a processing roller which cooperates with said one roller in the respective operative position and said compensating means is located on the side of said one roller remote from said processing roller.

59. The arrangement of claim 18, comprising at least one further roller movable between a further inoperative position and a further operative position in which said further roller cooperates with said roller means to process the material; and wherein said roller means comprises a processing roller which defines a further gap with said further roller, said path having a segment which includes only gaps defined by said processing roller.

60. The arrangement of claim 18, comprising a plurality of further rollers movable between respective further inoperative positions and respective further operative positions in which said further rollers cooperate with said roller means to process the material; and wherein said roller means comprises a plurality of processing rollers defining additional gaps with said further rollers, said path having a plurality of segments each of which includes only gaps defined by a respective processing roller.

61. The arrangement of claim 18, wherein said roller means comprises a pair of processing rollers, one of said processing rollers cooperating with said second roller in said second operative position and being arranged to contact one side of the material, and the other of said processing rollers being arranged to contact the other side of the material; and further comprising at least one further roller movable between a further inoperative position and a further operative position in which said further roller cooperates with said other processing roller to process the material, said drive means including a further drive mechanism for rotating said further roller at a peripheral speed lower than said predetermined speed when said further roller is in said further inoperative position.

62. The arrangement of claim 61, wherein said further drive mechanism is designed to rotate said further roller at a peripheral speed which is a small fraction of said predetermined speed when said further roller is in said further inoperative position.

63. The arrangement of claim 18, comprising at least one further roller movable between a further inoperative position and a further operative position in which said further roller cooperates with said roller means to process the material; and wherein said first and further rollers are arranged at spaced first locations along said path and said second roller is arranged at a second location intermediate said first locations.

64. The arrangement of claim 63, wherein all of said rollers are arranged to contact the same side of the material.

* * * * *